US008640634B2

(12) United States Patent
Saviharju et al.

(10) Patent No.: US 8,640,634 B2
(45) Date of Patent: Feb. 4, 2014

(54) COMBUSTION AIR SYSTEM FOR RECOVERY BOILERS, BURNING SPENT LIQUORS FROM PULPING PROCESSES

(75) Inventors: Kari Saviharju, Espoo (FI); Jorma Simonen, Marietta, GA (US); Raimo Paju, Varkaus (FI); Jukka Savolainen, Varkaus (FI); Esa Vihavainen, Varkaus (FI)

(73) Assignee: Andritz Oy, Helsinki (FI)

( * ) Notice: Subject to any disclaimer, the term of this patent is extended or adjusted under 35 U.S.C. 154(b) by 1111 days.

(21) Appl. No.: 11/577,290

(22) PCT Filed: Oct. 14, 2005

(86) PCT No.: PCT/FI2005/000447

§ 371 (c)(1),
(2), (4) Date: Dec. 21, 2009

(87) PCT Pub. No.: WO2006/040402

PCT Pub. Date: Apr. 20, 2006

(65) Prior Publication Data

US 2010/0101463 A1 Apr. 29, 2010

Related U.S. Application Data

(60) Provisional application No. 60/618,180, filed on Oct. 14, 2004.

(51) Int. Cl.

| | |
|---|---|
| ***F23G 7/04*** | (2006.01) |
| ***F23L 9/00*** | (2006.01) |
| ***F23D 1/00*** | (2006.01) |
| ***D21C 11/14*** | (2006.01) |

(52) U.S. Cl.
USPC ..... 110/238; 110/348; 110/347; 162/31

(58) Field of Classification Search
USPC ..... 110/348, 238; 162/31
See application file for complete search history.

(56) References Cited

U.S. PATENT DOCUMENTS 3,413,936 A * 12/1968 Matthews ..... 110/238
5,022,331 A * 6/1991 Simonen ..... 110/297

(Continued)

FOREIGN PATENT DOCUMENTS

EP 1 408 153 Al 4/2004
WO WO 02/081971 A1 10/2002

OTHER PUBLICATIONS

International Search Report mailed Feb. 13, 2006.

*Primary Examiner* — Khoa Huynh
*Assistant Examiner* — Timothy K Trieu
(74) *Attorney, Agent, or Firm* — Nixon & Vanderhye P.C.

(57) ABSTRACT

An arrangement is disclosed for supplying an air jet form to the furnace of a recovery boiler, where the furnace has a front wall, a rear wall and side walls. Black liquor spraying devices are disposed on the furnace walls on one or several levels of the furnace. A plurality of air ports are located at several horizontal elevations for introducing air into the furnace from an air supply. In the arrangement for the secondary air flows, at least two horizontal air levels at different elevations are arranged above the lower primary levels and below the black liquor sprayer. Secondary air is supplied from two opposite walls. The secondary air ports on each of said first and second horizontal elevations comprise air ports for each horizontal elevation that project a pattern of large air jets into the furnace from said opposite walls and said secondary air ports further comprise a plurality of secondary air ports on at least one of the elevations that project smaller air jets into the furnace.

32 Claims, 3 Drawing Sheets

(56) References Cited

U.S. PATENT DOCUMENTS

| | | | | | |
|---|---|---|---|---|---|
| 5,121,700 | A * | 6/1992 | Blackwell et al. | 110/348 |
| 5,305,698 | A * | 4/1994 | Blackwell et al. | 110/348 |
| 5,450,803 | A * | 9/1995 | Svensk et al. | 110/346 |
| 5,683,550 | A * | 11/1997 | Ryham | 162/30.1 |
| 5,701,829 | A * | 12/1997 | Raak | 110/238 |
| 5,715,763 | A * | 2/1998 | Fornetti et al. | 110/238 |
| 6,186,080 | B1 * | 2/2001 | Hino et al. | 110/238 |
| 6,302,039 | B1 * | 10/2001 | MacCallum et al. | 110/348 |
| 6,408,771 | B1 * | 6/2002 | Philippe et al. | 110/348 |
| 6,932,000 | B2 * | 8/2005 | Ruohola et al. | 110/238 |
| 7,185,594 | B2 * | 3/2007 | Higgins et al. | 110/238 |
| 7,207,280 | B2 * | 4/2007 | Saviharju et al. | 110/238 |
| 7,694,637 | B2 * | 4/2010 | MacCallum et al. | 110/347 |
| 2004/0221779 | A1 * | 11/2004 | Ruohola et al. | 110/348 |

* cited by examiner

Lower level

Upper level

COMBUSTION AIR SYSTEM FOR RECOVERY BOILERS, BURNING SPENT LIQUORS FROM PULPING PROCESSES

CROSS RELATED APPLICATION

This application is the US national phase of international application PCT/FI2005/000447 filed 14 Oct. 2005 which designated the U.S. and claims benefit of U.S. provisional patent application 60/618,180 filed 14 Oct. 2004, the entire contents of these applications are incorporated by reference.

FIELD OF THE INVENTION

The present invention relates to an arrangement for supplying air in an air jet form to the furnace of a recovery boiler. The furnace has a front wall, a rear wall and side walls. Black liquor spraying devices are disposed on these walls at one or several levels. A plurality of air ports are located on several horizontal levels on said walls for introducing air into the furnace from an air supply. Specifically, the invention relates to an arrangement for organizing the secondary air flows below the black liquor spraying devices.

BACKGROUND OF THE INVENTION

An optimal supply of combustion air in the lower part of the furnace of a black liquor recovery boiler plays a considerable role in the control of a combustion process in the boiler.

Since the chemical reactions in the kraft recovery boiler are very rapid, the speed of the process becomes substantially dependent on the mixing of combustion air and black liquor. This mixing step determines the burning rate and also has an effect on the process efficiency. Air and black liquor are typically introduced into the boiler through individual ports, and it is particularly important that a rapid mixing in the boiler is effected by the air supply without generating large differences in the upward flow profile. The high velocity "lift" in the center of the furnace is especially harmful as it results in carry-over of the sprayed liquor droplets. The burning symmetry must be controlled throughout the whole cross-sectional area of the boiler and the air supply must be adjusted when required.

Black liquor is generally introduced in the form of considerably large droplets into a kraft recovery boiler so as to facilitate the downward flow of the droplets, and to prevent them from flowing, unreacted (as fine fume), upwards together with the upward flowing gases to the upper part of the boiler. The large droplet size, which results in the droplets being spaced further from each other than in a fine black liquor spray, means that proper mixing is even more important in a recovery boiler. Pyrolysis of black liquor solids produces char as well as combustible gases. The char falls down to the bottom of the furnace and forms a char bed, which must be burned.

A stoichiometric amount of air, relative to the amount of black liquor, is introduced into the recovery boiler and additionally, a surplus amount of air is supplied to ensure complete combustion. Too much excessive air, however, causes a loss in efficiency of the boiler and an increase in costs. Air is usually introduced into the boiler on three different levels: primary air at the lower part of the furnace, secondary air above the primary air level but below the liquor nozzles, and tertiary air above the liquor nozzles to ensure complete combustion. Air is usually introduced through several air ports located on all four furnace walls, or only on two opposing walls of the furnace.

Primary air typically makes up 20-35% of the total air supplied into the furnace, depending on liquor and dry solids content of the liquor. The task of the primary air is to keep the char bed from rising into air ports of the furnace. Secondary air typically makes up 35-60% of total air, and tertiary air, which may be distributed into several levels in vertical direction, typically makes up 10-40% of the total air. More than three air levels for introducing air into the furnace may be arranged in the boiler.

Mixing of black liquor and air is difficult because of the upflow of gas, which is formed in the center part of the boiler, through which it is difficult for the weak secondary air flow to penetrate. More specifically, the primary air flows, supplied from the sides in the bottom part of the boiler, collide with each other in the center part of the boiler and form, with secondary air flow pattern, in the center part of the boiler, a gas flow flowing very rapidly upwards, catching flue gases and other incompletely burnt gaseous or dusty material from the lower part of the furnace. This gas flow, also called a "droplet lift", also catches black liquor particles flowing counter-currently downwards and carries them to the upper part of the boiler, where they stick to the heat surfaces of the boiler, thus causing fouling and clogging. In the center part of the boiler, the speed of the upwardsflowing gas may become as much as four times as great as the average speed of the gases as a result of incomplete or weak mixing. Thus, a zone of rapid flow is formed in the center part of the boiler, and this renders mixing of flue gases from the side of the flow very difficult to achieve.

The "droplet lift" mentioned above, results in such a situation where the tertiary air(s) has (have) to burn not only the unburned gases from combustion (CO, $H_2S$, $NH_3$, etc.), but the unburned char from the droplets as well. As the combustion rate for char is much slower than for the unburned gases, increased amount of excess oxygen has to be used to ensure complete combustion. Then the flue gas leaving the furnace contains higher amounts of residual CO and $H_2S$, and the utilization of the furnace is less effective than would be possible.

Current secondary air arrangements are also characterized by at least one secondary air level where secondary air ports are placed close to another in horizontal direction. This leads to mixing patterns where furnace gases are circulated in vertical direction, with the above mentioned "lift", i.e. they flow towards the walls and then turn up (or down) and follow the main flue gas direction.

Another variation of the secondary air design is to use partial interlaced jets (e.g. U.S. Pat. Nos. 5,121,700, 5,305,698), whereby a large jet opposes a small jet. The large and small jets are alternated between the two opposite walls used.

U.S. Pat. No. 5,724,895 discloses an arrangement for feeding combustion air. In this system, a more favorable flow pattern in furnaces can be achieved by replacing vertical mixing by horizontal mixing, whereby a strong central flow channel, upward "lift", can be prevented. This horizontal mixing is applied for the whole furnace. The horizontal mixing is improved by disposing additional air inlet ports e.g. at more than six different elevations in a pattern of vertical spaced-apart rows above the lowest air levels.

In the method of U.S. Pat. No. 5,454,908 a portion of combustion air is introduced into a recovery boiler at a distance above the black liquor inlet so as to provide a reducing atmosphere with a residence time of at least three seconds between the black liquor inlet and the introduction of said portion of combustion air. A drawback of the described arrangement is a high vertical combustion area, reaching in extreme cases the bullnose of the furnace. As this combustion area has a reducing atmosphere, at least locally, more expensive materials have to be used in the furnace to a higher position than would be needed if combustion took place lower in the furnace. Other disadvantages of the air systems, where combustion takes place high up in the furnace include high furnace outlet temperature resulting in large convective heat transfer surfaces later in the boiler, lower temperature in the lower furnace, and more expensive layout. The lower temperature in the lower furnace does not allow as high sulfidity without $SO_2$ emissions as a combustion system having a higher lower furnace temperature does.

WO 02/081971 discloses an arrangement for supplying secondary air in an air jet form to the furnace of a recovery boiler. The furnace has a front wall, a rear wall and side walls, black liquor spraying devices disposed on said walls on a level and a plurality of air ports located on several horizontal levels on said walls for introducing air into the furnace from an air supply. The arrangement comprises two horizontal air levels at different elevations, which air levels are arranged above the lowest air level or levels and below the black liquor spraying level or levels. Air is supplied from two opposite walls on the two levels and the air ports are located so that the air jets are introduced in an interlaced pattern. The air jets of said the at least two air levels are located substantially one above each other in substantially vertical rows.

SUMMARY OF THE INVENTION

The present invention provides an improved air supply system of combustion air to a furnace of a recovery boiler. A secondary combustion air supply is provided in which either local and/or central upward gas flows having a high velocity compared to an average upward gas velocity are efficiently avoided. Another feature of the invention is to enable a constant penetration of combustion air into the boiler at different loading levels. A further feature of the invention is to produce a better mixing of black liquor and combustion air in the furnace. Further, an air jet projected from a wall towards the opposite wall may contribute to formation of black liquor deposits on a furnace wall, and according to a further feature of the invention black liquor droplets are prevented from being thrown to the furnace walls. The improved air supply arrangement of this invention is also designed to reduce the amount of harmful emissions from the boiler furnace. In connection with this invention, air can be other oxygen-containing gas, such as flue gas.

The present invention may be embodied in a recovery boiler having a furnace that comprises:

a first elevation of secondary air ports arranged on opposite walls of said furnace;

a second elevation of secondary air ports on said opposite walls, and wherein said first and second horizontal elevations of secondary air ports are vertically lower on said walls than the black liquor horizontal spraying? elevation and are vertically above the primary air ports, and the secondary air ports at each of said first and second horizontal elevations on said opposite walls comprise air ports for each horizontal elevation that project a pattern of large air jets into the furnace from said opposite walls and said secondary air ports further comprise a plurality of secondary air ports at at least one of the elevations that project smaller air jets into the furnace, According to an embodiment of the invention, secondary air on two air levels is introduced only from the two opposite walls, preferably from the front and rear walls.

Preferably, substantially no secondary air is supplied from the two remaining walls, i.e., the side walls. Preferably, air is introduced in an interlaced pattern. The interlaced pattern of air jets can be achieved by arranging the ports at the same elevational level such that an odd number of ports are on one wall and an even number of ports on the opposite wall of the furnace or having an equal number of air jets on the opposite walls so that an air flow coming from an air port located on the first wall is directed in between two adjacent air ports of the opposite wall. Correspondingly, the air jets coming from the opposite wall are directed substantially directly in a horizontal plane towards the first wall. The air jets coming from the opposite walls by-pass each other without actually colliding with each other.

Thus, on the two secondary levels, the lateral arrangement of the jets on one level sideways can be symmetrical. On the wall having an uneven number of air jets, e.g. three, the middle air jet is located substantially on the center line of the wall, and the other jets are located within an equal distance on both sides of the middle jet. On the opposite wall having an even number of jets, two in this example, the jets are located laterally midway between the jets on the opposite wall. Thus, the jet arrangement is symmetrical in relation to the vertical plane parallel to the remaining walls (i.e. the walls having no secondary air jets) and passing through the center lines of the walls having the secondary air jets.

The present invention employs the following principles in order to avoid strong vertical gas flows, but still to obtain effective mixing in the furnace between combustion air and unburned/burning liquor droplets:

- strong secondary air jets (strong air jets below black liquor spraying devices);
- arranging these jets so that they do not collide against each other, which easily generates strong upflow jets and unwanted upflow profile for the gases in the furnaces. Instead, strong shearing flows should be generated to obtain good mixing;
- minimizing suction of gases in vertical direction into these jets above the liquor spraying devices as this increases gas flow up;
- preventing black liquor droplets from being thrown to furnace walls;
- minimizing suction of liquor droplets from liquor sprays into tertiary air jets;
- covering the tertiary air stage(s) with several jets, which cover the furnace cross section evenly and well in order to prevent the formation of vertical jets that might punch the final combustion area, whereby the final combustion of the unburned gases could not take place. Also, here the jets should not collide against each other but generate strong shearing flows and good mixing.

According to a preferred embodiment of the invention, there is a distance, V, in vertical direction between the horizontal air levels, when measured from the lateral centerlines of the air ports of the air levels. This distance, V, fulfills the following formula: $V/L \leq 0.5$, where L is the distance between two adjacent air ports on the same air level, when measured from the longitudinal centerlines of the adjacent air ports. Preferably, V/L is 0.25-0.5. Typically, the vertical distance, V, is 1-2 meters.

Preferably the air ports located one above the other are positioned in a vertical row so that they are located in the same straight vertical line. The invention covers also an embodiment in which the air ports laterally deviate so that there is a transverse distance, D, between the air ports above each other. The transverse distance is a distance between the longitudinal centerlines of the ports one above the other. D is less than 1.5×H or less than 1.5×W depending on which number is greater. H is the height of the highest air port and W is the width of the widest air port.

According to an embodiment of the invention there is only one air level below the secondary air levels. According to another embodiment, the number of the lowest air levels below the two secondary air levels is two. The air jets of the air level which is located higher in vertical direction below the two secondary air levels are arranged in an interlaced pattern on two opposite walls, preferably on the front and rear walls, so that the number of air jets is greater by one than the number of air jets of the two secondary air levels on the same wall. For example, if the secondary air level has one air jet on the front wall and two jets on the rear wall, the above-mentioned lower air level has two air jets on the front wall and three jets on the rear wall. However, the air velocity is lower on this lower air level. On this air level, which thus, is located above the lowest air level and below the two secondary air levels, and which can be called a low-secondary or high-primary air level, the air jets are arranged also on the remaining opposite walls, i.e., preferably on the side walls. The air jets on the side walls are smaller than the air jets on the front and rear walls.

SUMMARY OF THE DRAWINGS

The invention will be described in more detail with reference to the attached drawings, in which.

DETAILED DESCRIPTION OF AN EMBODIMENT OF THE INVENTION

Figure 1:
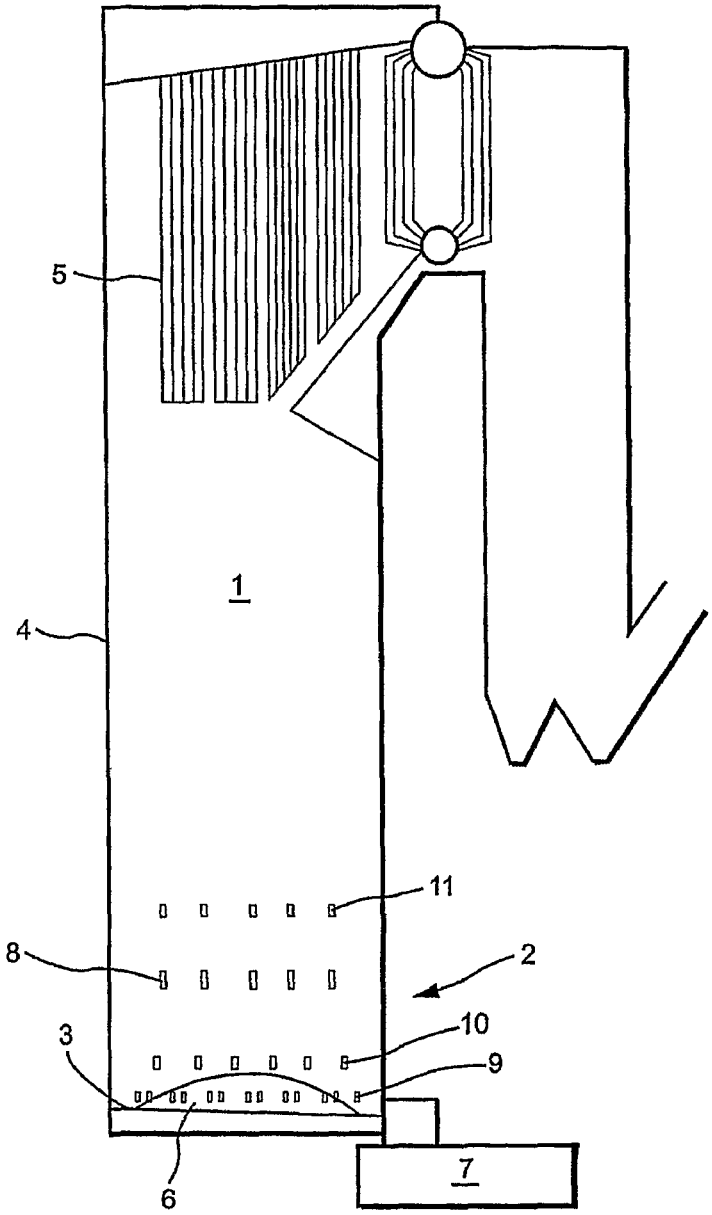
FIG. 1 illustrates a schematic cross-sectional view of a recovery boiler.

FIG. 1 illustrates a conventional recovery boiler. The boiler 1 comprises a furnace 2 provided with a bottom, boiler walls 4, and a super heater 5. In the combustion process, a bed of dried and partly burnt black liquor is formed at the bottom of the furnace. Melt chemicals flow through the porous bed to the bottom of the furnace, from where they are transferred as an overflow via melt chutes to a dissolving tank 7. Black liquor is introduced to the furnace through openings in zone 8. Air is introduced from three different levels: primary air ports 9, secondary air ports 10 and tertiary air ports 11.

As known, the recovery boiler furnace has a front wall, a rear wall and side walls. Black liquor spraying devices are disposed on these walls at one or several levels. A plurality of air ports are located on several horizontal levels on said walls for introducing air into the furnace from an air supply.

The air ports of the furnace for supplying secondary air are arranged in a specific way. In connection with this invention, the term "secondary air" is used to refer to the air that is introduced between the lowest air level, i.e., the primary air level, and the black liquor spraying level or levels. In the arrangement of the invention the secondary air is supplied as interlaced jets of air projected from opposite walls on at least two levels, preferably on two levels.

Figure 3:
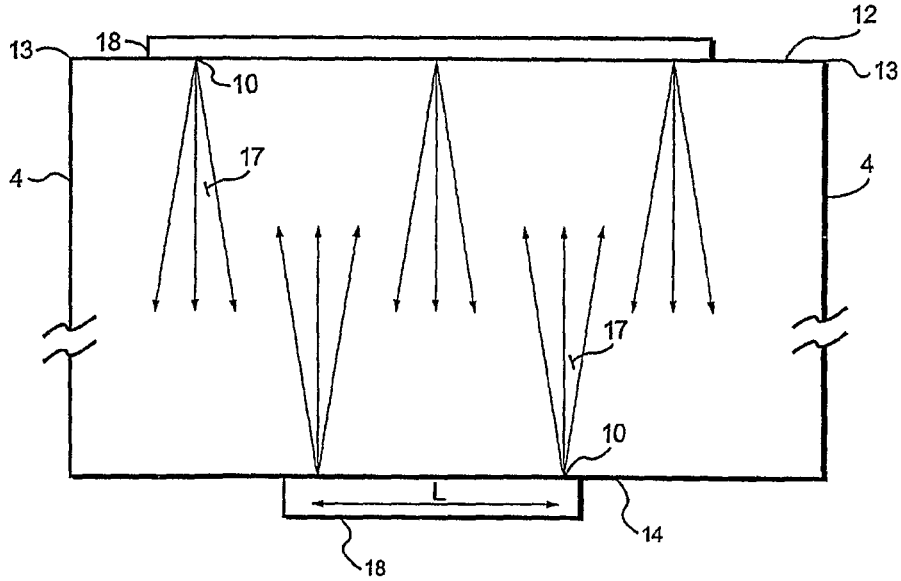
FIG. 3 illustrates a plan view of the lower furnace of a recovery boiler with an arrangement of air jets according to an embodiment of the invention.

Each secondary air level has an even number of ports for jets on one opposite wall and an uneven number of ports for jets on the other opposite wall, as shown in FIG. 3. In this interlaced pattern, an air flow coming from an air port located on a wall having an even number of air ports is directed in between two adjacent air ports of the opposite wall having an uneven number of air ports. The air flows coming from the opposite walls by-pass each other without actually colliding with each other. The air ports of the different air levels are located on the same walls, e.g., on the front and rear walls.

Figure 2:
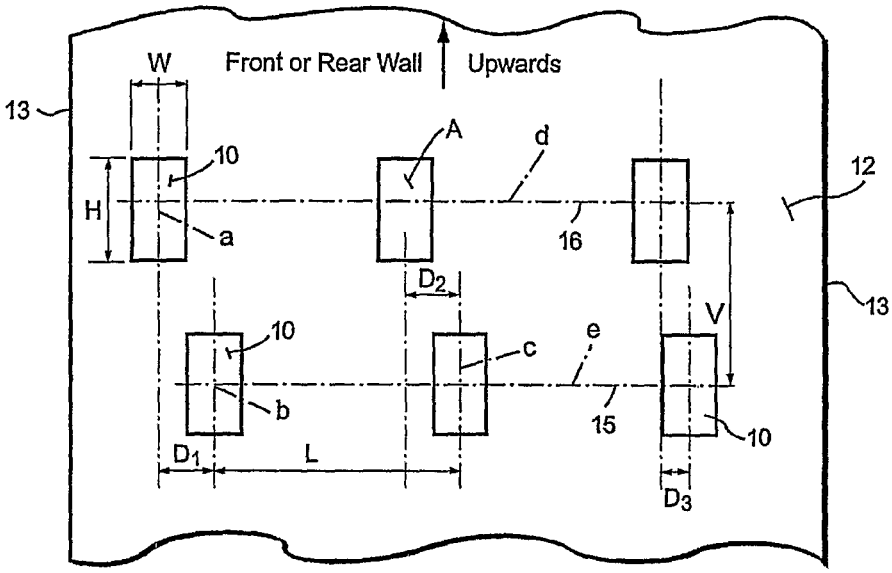
FIG. 2 illustrates a side view of the lower furnace of a recovery boiler with an air port arrangement according to an embodiment of the invention.

FIG. 2 is a schematic side view of a lower portion of one wall 12 in the boiler 1, such as a rear wall that is opposite to a front wall 14 (see FIG. 3). The wall 12 shows the air ports 10 for the secondary air. The air ports for the primary air are below the air ports 10, but are not shown in FIG. 2. The wall section shown in FIG. 2 is below the black liquor injection nozzles and above the primary air ports 9. The side edges 13 of the wall abut with other side walls 4 in the furnace. The secondary air ports 10 shown in FIG. 2 may be also arranged on an opposite wall 14 of the furnace (as is shown in FIG. 3) and may also be arranged on more than two walls in the furnace. The secondary air ports 10 are supplied with secondary air by an air supply 18, which provides air for combustion from atmospheric air, by circulating flue gases recovered from the boiler, and/or from a supply of odorous gases from another process in the plant.

The secondary air ports are arranged in a first row at a first horizontal level 15 and a second row at a second horizontal level 16. The secondary air ports 10 are aligned in elevational levels one above the other. The air ports of each level 15, 16 are located in rows so that there is a transverse distance L in a horizontal direction between adjacent ports 10 at the same level. In addition, the secondary air ports may or may not be vertically aligned between the two rows 16, 15. As shown in FIG. 2, the air ports at a first elevation 15 are offset from their vertically-adjacent ports at the second elevation 16 by a horizontal offset distance $D_x$. The distance $D_x$ is an offset distance between the longitudinal centerlines of two vertically adjacent air ports. This distance $D_x$ is zero for air ports that are vertically aligned between the two rows.

In FIG. 2, $D_1$ is a distance between longitudinal centerlines a and b, which correspond respectively to vertically-adjacent secondary air ports 10 one above the other. Similarly, $D_2$ and $D_3$ are the distances between the centerlines of other pairs of vertically adjacent secondary air ports. $D_1$ is generally less than 1.5×H or less than 1.5×W depending on which number is greater. H is the height of the tallest air port 10 and W is the width of the widest air port of each pair of vertically adjacent air ports. Preferably the transverse distance ($D_x$) is less than 1.0×H or less than 1.0×W, whichever is greater. Typically the transverse distance $D_x$ between two vertically adjacent air ports is in a range of 0.075 to 0.16 meters. Because of the water circulation in the cooling tubes that form the walls 4, 12, 14 of the furnace, it may be advantageous to have the transverse distance ($D_x$) between the vertically adjacent air ports confined to the ranges stated herein.

In addition, the two secondary air levels 15, 16 are located so that there is a vertical distance (V) between the secondary air levels, 15, 16. The vertical distance V is measured as a distance in a vertical separation between the lateral center lines (d, e in FIG. 2) of the rows 15, 16 of secondary air ports. This distance V should preferably fulfill the following formula: $V/L \leq 0.5$, where L is the distance between two adjacent air ports in the same row 15, 16, when measured from the longitudinal center lines of the adjacent air ports. Typically V/L is 0.05-0.5, and preferably 0.25-0.5. Typically the vertical distance, V, is 1-2 meters.

The value of the distance L between secondary air ports in the same row depends on, for example, the number of secondary air ports in that row on the wall of the furnace. There may be an even number of ports in a row on one wall and an odd number of ports in the same row on the opposite wall. When there is an even number of ports in a row on one wall and an uneven number of ports in the opposite row on the opposite wall, the value of L used in the above formula may be the minimum of L value in the two opposing rows.

Preferably, the shape of the secondary air ports 10 is close to a hexahedral form to minimize the area of uncooled fin areas. The air ports have an area (A) and a width, W. Preferably the ratio between the port area (A) and the square of the width (W) is greater than 4, which ratio may be expressed as $A/W^2 \geq 4$, but this ratio may also be smaller than 4. For instance, the ratio of $A/W^2$ can vary from 5 to 10. A feature of the invention is that each air port is closer to the air port located above it than to an adjacent air port at the same level. In the extreme case the vertical distance V is close to 0, whereby two air ports located above each other are to be replaced with one air port that is very high and narrow. Typically, the lowest primary air port level is located about 0.7 to 1.0 meters from the floor of the furnace (from the smelt level). The distance between the primary level and the lowest secondary levels 15, 16 having air jets only on two walls is about 0.8-1.5 meters, in which case the lowest secondary level 15 is about 1.5-2.5 m from the floor of the furnace (from the smelt level).

The air ports of the same secondary air level do not have to be located exactly at the same elevation on the opposite walls. This means that the air jets on the opposite walls on the same air level are not located in the same horizontal plane. However, the difference between the elevations of the air ports of the same level on the opposite walls is less than 10% of the depth of the furnace.

According to a preferred embodiment the air jets of the secondary air levels are located on the front and rear walls of the furnace, but the arrangement of the invention can be applied to the side walls of the furnace as well.

The number of jets on the secondary air levels is characterized by the following numbers, depending on the spent liquor dry solids combustion capacity of a recovery boiler capacity:

where the boiler capacity is less than 500 metric tons of dry solids per day (DS/d): 1+2 jets per secondary air level (6 jets together in the case of two air levels).

capacity is 500-1500 metric tons D.S./d: 1+2 or 2+3 jets per level.

capacity is 1500-2500 metric tons D.S./d: 2+3 or 3+4 jets per level.

capacity is 2500-4000 metric tons D.S./d: 2+3, 3+4 or 4+5 jets per level.

capacity is greater than (>) 4000 metric tons D.S./d: 3+4, 4+5, 5+6 or 6+7 jets per level.

Where "1+2 jets per level" means that one air port providing an air jet is located on one of the opposite walls and two ports for jets are on the other of the opposite walls. FIG. 3 shows a 2+3 arrangement of air ports on one level providing interlaced air jets.

As shown on the single secondary air port level shown in a top view in FIG. 3, the ports 10 (and hence air jets 17) are arranged such that there is an interlaced pattern of air jets projecting in towards the center of the furnace. On a first wall, such as a rear wall 12, of the furnace there are three air ports arranged on one elevational level, such as the secondary air ports providing the three jets shown in FIG. 3. The opposite wall, such as the front wall 14, has two air ports 10. The air ports on one level do not face directly across each other on the opposite walls. Rather, the air ports on the same elevational level, e.g., secondary air levels, but on opposite walls are offset from each other. The offset of opposite air ports on opposite walls promotes an interlaced pattern of air jets projecting towards the center of the furnace. The interlaced pattern of air jet scan be achieved by arranging the ports on the same elevational level such that an odd number of ports are on one wall and an even number of ports on the opposite wall of the furnace or having an equal number of air jets on the opposite walls.

The velocity of the secondary air supplied through the air ports into the furnace is preferably at least 40 m/s (meters per second). In order to prevent the formation of vertical jets that might punch the final combustion area where the final combustion of the unburned gases should take place, the number of air jets on each tertiary air level in the arrangement is higher than the number of the air jets on the secondary air levels. Preferably, the vertical distance between the lowest tertiary air level and the black liquor spraying level is more than two times greater than the vertical distance between each secondary air level.

The combustion air supply 18 can be connected to means for conveying flue gas from the recovery boiler in order to recirculate a portion of the flue gas into the furnace. The air supply 18 can also be connected to a line for odorous gases for introducing the gases into the furnace.

Figure 4:
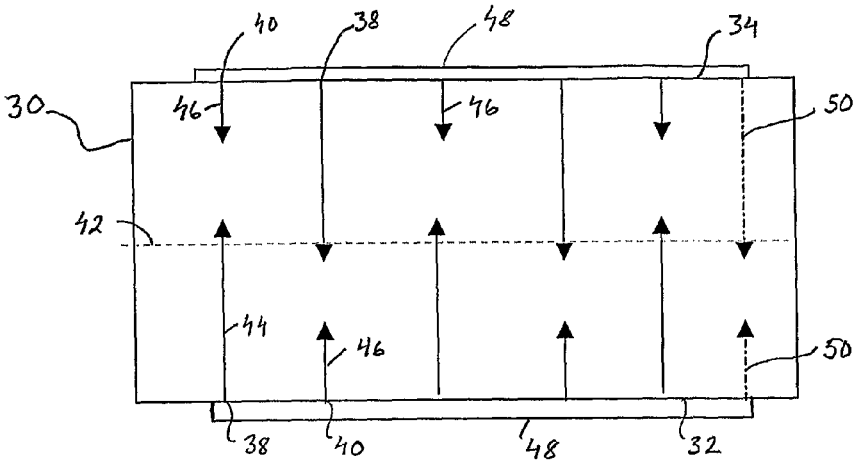
FIG. 4 illustrates a plane view of the interior of the recovery burners at a lower secondary air port horizontal level.
Figure 5:
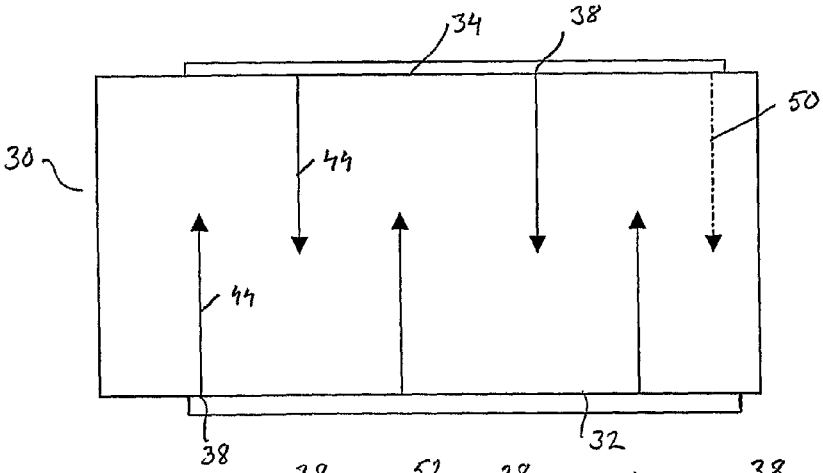
FIG. 5 illustrates a plane view of the interior of the recovery boiler at an upper level of secondary air ports.
Figure 6:
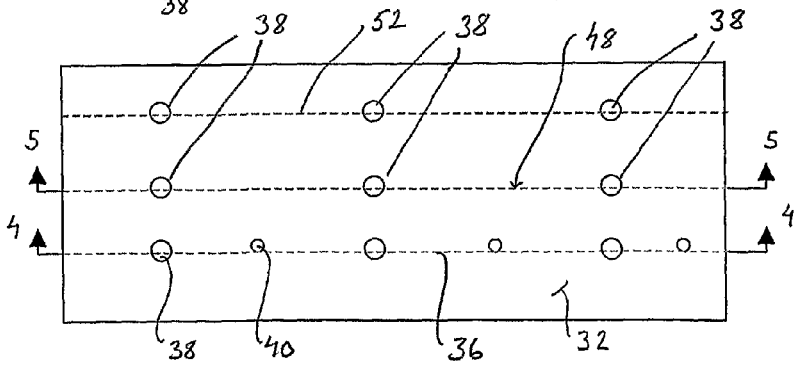
FIG. 6 illustrates a side view showing the arrangements of the upper and lower secondary air ports illustrated in FIGS. 4 and 5.

FIGS. 4, 5, and 6 illustrate an alternative arrangement of secondary air ports for a recovery boiler. FIG. 4 is a plane view of the interior of the recovery boiler on a lower secondary air port horizontal level. FIG. 5 is a plane view of the interior of the recovery boiler on an upper level of secondary air ports. FIG. 6 is a side view showing the arrangements of the upper and lower secondary air ports illustrated in FIGS. 4 and 5.

In FIG. 4, a recovery air boiler 30 includes a front wall 32 and a rear wall 34 having opposing secondary air jets. Except for the arrangements of secondary air jets, the recovery boiler 30 shown in FIGS. 4, 5 and 6 is substantially similar to the recovery boiler shown in FIGS. 1, 2 and 3. For example, the shape and size of the larger secondary air ports 38 shown in FIGS. 4, 5 and 6 may be the same as the secondary air ports shown in FIG. 2.

As shown in FIG. 4, the lower horizontal level 36 of secondary air ports comprises alternating ports 38 for larger jets and ports 40 small jets. The ports for large jets project air jets further across the width of the recovery of the boiler than do the ports 40 for smaller jets. For example, the ports 38 may project large jet streams 44 that extend beyond the half-way line 42 of the width of the recovery boiler. In contrast, the smaller jet streams 46 from the ports 40 may extend substantially short of the mid line 42.

The air streams entering 44, 46 through the secondary air ports enter the flow of combustion gases and fluid gases flowing upwardly through the recovery boiler. As secondary air streams enter the recovery boiler, they mix with the combustion of gases flowing through the boiler. By increasing the aperture of the secondary air port, the secondary air ports 38 form defined larger secondary air jets 44 that extend relatively far into the recovery boiler. By reducing the aperture area, the smaller secondary air ports 40 form defined, small secondary air jet streams 46 that do not extend as defined large jet streams far into the interior of the recovery boiler. The relatively small volume streams 46 contribute to controlling the zones between the adjacent large jets. They prevent black liquor droplets from being thrown to the furnace walls. On the lower level 36 the small jets complete the air flow cover over the char bed to make char bed control easier. The combination of large volume and low volume secondary air streams 44, 46 on multiple horizontal levels forms a pattern of secondary air flow having a substantial horizontal component on a level in the boiler above the lower portion of the boiler where most combustion occurs and below the black liquor injection ports 8. The pattern of secondary air tends to prevent the formation of strong upflow gas streams and thereby minimizes droplet uplift of black liquor.

The larger secondary air ports 38 may have substantially the same size and shape as do the air ports shown in FIGS. 2, 3. Moreover, the vertical alignment of the larger secondary ports 38 on the upper level (elevation) 48 and lower level 36 may be substantially the same as the alignment of the upper and lower secondary air ports shown in FIG. 2. The large secondary air ports on each of the two horizontal levels are vertically aligned and offset the horizontal level. On each horizontal level, the large secondary air ports are paired with another large secondary port on another level. At horizontal levels, a large secondary air port on one wall of the boiler preferably does not face directly a large secondary air port on the opposite wall. Accordingly, pairs of vertically aligned large secondary air streams 44 from one boiler wall form an interlaced pattern with pairs of large secondary air streams 44 from the opposite boiler wall.

The lower horizontal level 36 is provided with additional small secondary air ports 40 that are arranged between the larger secondary air ports 38. The lower level 36 secondary air ports are shown as having alternate large port diameter 38 and small port diameter 40 secondary air ports. Preferably, the smaller air ports 40 are aligned generally opposite to a larger secondary air port 38 on an opposite boiler wall. The smaller secondary air ports 40 project a secondary air stream 46 that faces a larger secondary air stream 44 from a larger secondary air port 38. The volume of the smaller secondary air streams 46 may be approximately 25% of the volume of a larger secondary air stream 44.

In the embodiment enclosed herein, only the lower horizontal level 36 has small secondary air ports 40 and the smaller ports are between each of the larger ports. In an alternative embodiment, the middle section of the front or rear walls 32, 34 of the recovery boiler, e.g., the middle 50% of the wall, may not have small secondary air jets 46. Directing small secondary air jets 46 only close to or substantially at the corners of the boilers prompts strong secondary air flows at the corners. Moreover, the arrangement of small secondary air ports on the lower and/or upper levels is a matter of design.

The air flow of the small jets 46 is substantially smaller in volume than the air flow of the large secondary air streams 44. For example, the small jets 46 may have a momentum (the product of the air mass flow times the air velocity) of air flow of approximately less than 50%, preferably 25-40% of the momentum of air flow of a large jets 44. The relative difference in the volume air flow of the large jets and small jets may be formed by selecting the sizes of the apertures of the secondary air ports 38, 40 and/or providing air supply 48 to the secondary air ports 38 for large jets at a pressure substantially greater than the air supply to the secondary airports 40 for small jets. In the embodiment shown in FIGS. 4 and 5, the air supply 48 is common to both the small and large secondary air ports. In these embodiments by adjusting the size of the air ports 38 and 40, the volume of air flow through each port and thus the volume of air in the secondary air stream 44, 46 may be determined for small and large secondary air streams. In an alternative embodiment, the ports 38 for large jets have a high pressure air supply and the ports 40 for small jets may have a lower pressure air supply, in which case the size of the opening of the ports 38 and 40 can be substantially equal.

FIG. 4 shows an interleaving arrangement of larger secondary air ports 38 which generate corresponding interleaving large secondary air streams 44. The addition of smaller secondary air ports 40 provides a means for introducing additional secondary air into the boiler, without substantially interfering with the interleaving of the large ports. The small jets can have a separate air supply. In an embodiment the air/gas supply to the secondary air ports for small jets is in fluid communication with flue gas from the recovery boiler to recirculate a portion of the flue gas to the furnace. In another embodiment the air supply for the small secondary air jets is in fluid communication with a supply of non-condensable gases, e.g. dilute non-condensable gases, for introducing the non-condensable gases to the furnace. In a further embodiment the gas supply for the small secondary air jets is in fluid communication with a supply of primary air or secondary air.

The upper level of secondary air ports 48 shown in FIGS. 5 and 6 is formed entirely of larger streams 44 provided by large air ports 38. At the upper level 48 there are no smaller secondary air ports 40. The large jets 44 are in an interlaced pattern. The large secondary air ports 38 on the upper level are substantially vertically aligned with the large secondary air ports 38 on the lower level 36. There may be only two large secondary air ports 38 vertically aligned with one another in the secondary air port arrangement.

The number of large secondary air ports 38 is shown in FIGS. 4 and 5 as an odd number of ports on one side of the boiler and an even number of ports on the other side of the boiler. However, both sides of the boiler may have an equal number of ports as shown by dotted lines 50 so that an interlaced pattern is formed. The number of large and small secondary air ports on the front wall and rear wall of the boiler is a matter of design choice.

The number of elevation levels of secondary air ports may be two or more. FIG. 6 shows three levels of secondary air ports. The levels of secondary air ports are arranged vertically between the primary secondary air ports and below the black liquor injectors. At the horizontal level of the black liquor injectors there are not air injection ports. For example, two levels of secondary air ports 36, 48 may be added to an existing boiler having an existing elevational level 52 of secondary air ports 38. The new levels of secondary air ports may be added above, below, between or include the elevations of existing secondary air ports.

Various embodiments of this invention have been described in fulfillment of the various needs that the invention meets. It should be recognized that these embodiments are merely illustrative of the principles of various embodiments of the present invention. Numerous modifications and adaptations thereof will be apparent to those skilled in the art without departing from the spirit and scope of the present invention. Thus, it is intended that the present invention cover all suitable modifications and variations as come within the scope of the appended claims and their equivalents.

The invention claimed is:

1. A furnace of a recovery boiler comprising:

a front wall, a rear wall and side walls to the furnace, at least one black liquor spraying device disposed at or above a black liquor spray elevation on at least one of said walls;

a plurality of primary air ports on at least one of said walls;

a first elevation of secondary air ports arranged on opposite walls of said furnace and arranged to project a pattern of air jets into the furnace from said opposite walls; and a second elevation of secondary air ports on said opposite walls adjacent in a vertical direction to the first elevation, the secondary air ports at the second elevation including large air ports and small air ports, wherein the large air ports are arranged to project a pattern of large air jets into the furnace from said opposite walls, and the small air ports at the second elevation are each smaller than each of the secondary air ports at the first elevation, and for each of opposite walls, the large air ports are each vertically aligned with one of the secondary air ports at the first elevation on the same one of the opposite walls, wherein said first and second horizontal elevations of secondary air ports are vertically lower on said walls than the black liquor horizontal spray elevation and are vertically above the primary air ports.

2. The furnace of claim 1, wherein the small air ports each project small jets having a momentum no greater than 50% of a momentum of large air jets projected from any of the large air ports.

3. The furnace of claim 2, wherein the momentum of each of the small air jets is in a range of 25% to 40% of the momentum of any one of the large air jets.

4. The furnace of claim 1, wherein the furnace further comprises a third elevation of secondary air ports above the first and second elevations, wherein substantially all secondary air enters the furnace through said ports in the first, second and third elevations of secondary air ports.

5. The furnace of claim 1, wherein said opposite walls are the front and rear walls of the furnace and opposite side walls of the furnace lack secondary air ports.

6. The furnace of claim 1, wherein the small secondary air ports each have an area less than 50% of an area of any one of the large secondary air ports.

7. The furnace of claim 1, wherein the small secondary air ports comprise small secondary air ports arranged near a corner of the furnace.

8. The furnace of claim 1, wherein on at least one of the elevations a middle section of at least one of the opposite walls is devoid of small secondary jets.

9. The furnace of claim 8, wherein the middle section is at least 50% of a width of each of said opposite walls.

10. The furnace of claim 1, wherein the primary air ports include an upper elevation of the primary air ports each having a vertical centerline that is offset horizontally from a vertical centerline of the large secondary air ports at the second elevation of air ports.

11. The furnace of claim 1, wherein a velocity of the air jets passing through the secondary air ports is at least 40 meters per second (m/s).

12. The furnace of claim 1, wherein the furnace has at least one tertiary elevation of tertiary air ports arranged above the black liquor spraying elevation.

13. The furnace of claim 12, wherein a vertical distance between a lowest of the at least one tertiary air elevation and the black liquor spraying elevation is at least two meters.

14. The furnace of claim 1, wherein an air supply for the small air ports is in fluid communication with flue gas from the recovery boiler to recirculate a portion of the flue gas to the furnace.

15. The furnace of claim 1, wherein an air supply for the secondary air ports is in fluid communication with a supply of non-condensable gases for introducing the non-condensable gases to the furnace through the secondary air ports.

16. The furnace of claim 1, wherein an air supply for the small secondary air ports is in fluid communication with a supply of dilute non-condensable gases for introducing the dilute non-condensable gases to the furnace through the small secondary air ports.

17. The furnace of claim 1, wherein a gas supply for the small secondary air ports is in fluid communication with a supply of primary air for the primary air ports.

18. The furnace of claim 1, wherein an air supply for the small secondary air ports is in fluid communication with a supply of secondary air which supplies secondary air to the air ports in the first and second elevations.

19. The furnace of claim 1, wherein small secondary air jets projected through the small air ports prevent black liquor droplets from being thrown to the furnace walls.

20. The furnace of claim 1, wherein the large air jets of secondary air projected from the large air ports form an interlaced pattern of secondary air in the furnace.

21. The furnace of claim 1, wherein three of the large air ports are on one of the opposite walls and two of the large air ports are on the other of the opposite walls.

22. The furnace of claim 1, wherein the air ports in the first elevation include large air ports, and three of the large air ports are on one of the opposite walls at each of the first and second elevations, and two of the large ports jets at each of the first and second elevations are on the other of the opposite walls.

23. The furnace of claim 1, wherein two of the large air ports are one of the opposite walls and three of the large air ports are on the other of the opposite walls.

24. The furnace of claim 1, wherein the air ports at the first elevation include large air ports, and five of the large air ports at each of said first and second elevations are on one of the opposite walls, and three of the large air ports at each of the first and second elevations are on the other of the opposite walls.

25. The furnace of claim 1, wherein three of the large ports jets are on one of the opposite walls and four are on the other of the opposite walls.

26. The furnace of claim 1, wherein the air ports at the first elevation include large air ports, and three the large air ports are on one of the opposite walls and four of the large ports are on the other of the opposite walls.

27. The furnace of claim 1, wherein said black liquor spraying elevation is substantially devoid of air ports.

28. A furnace of a recovery boiler comprising:

walls to the furnace, wherein at least two of the walls are opposing walls on opposite sides of a vertical passage for combustion gases formed in the furnace;

at least one black liquor spraying device disposed at or above a black liquor spray elevation on at least one of walls;

a plurality of primary air ports on at least a first wall of said opposing walls;

a first elevation of secondary air ports arranged on said opposing walls and arranged to project a pattern of air jets into the vertical passage;

a second elevation of secondary air ports on said opposing walls, wherein said secondary air ports include large air ports and small air ports, wherein the large air ports on the first wall are each horizontally aligned with one of the small air ports on an opposite one of the opposing walls, the large air ports are each vertically aligned with one of the air ports at the first elevation on the first wall, and the small air ports in the second elevation are each smaller than any of the secondary air ports at the first elevation, and wherein said first and second horizontal elevations of secondary air ports are vertically lower than the black liquor horizontal spray elevation and are vertically above the primary air ports, and the second elevation is below the first elevation.

29. The furnace recovery boiler in claim 28 wherein the large air ports are on both of the opposing walls and project an interlaced pattern of air jets into the vertical passage.

30. The furnace recovery boiler as in claim 28 wherein the air ports at the first elevation are each at least of a size equal to one of the large air ports at the second elevation.

31. The furnace recovery boiler as in claim 28 wherein the small air ports at the second elevation are vertically offset from the air ports at the first elevation.

32. The furnace recovery boiler as in claim 28 wherein the first and second elevations are at adjacent elevations.

* * * * *